US006908048B2

(12) United States Patent
Di Gioia et al.

(10) Patent No.: US 6,908,048 B2
(45) Date of Patent: Jun. 21, 2005

(54) DEVICE FOR SUPPLYING A POWDERY COATING PRODUCT TO A SPRAYER AND SPRAY INSTALLATION COMPRISING SAME

(75) Inventors: Michel Di Gioia, Seyssinet Pariset (FR); Francois Vasseur, Grenoble (FR)

(73) Assignee: Sames Technologies, Meylan (FR)

( * ) Notice: Subject to any disclaimer, the term of this patent is extended or adjusted under 35 U.S.C. 154(b) by 0 days.

(21) Appl. No.: 10/343,632

(22) PCT Filed: Aug. 1, 2002

(86) PCT No.: PCT/FR01/02517

§ 371 (c)(1),
(2), (4) Date: Jul. 22, 2003

(87) PCT Pub. No.: WO02/09886

PCT Pub. Date: Feb. 7, 2002

(65) Prior Publication Data

US 2004/0020535 A1 Feb. 5, 2004

(30) Foreign Application Priority Data

Aug. 2, 2000 (FR) ..... 00 10226

(51) Int. Cl.[7] ..... B05B 5/03
(52) U.S. Cl. ..... 239/302; 239/304; 239/353
(58) Field of Search ..... 239/93–94, 101, 239/262, 270, 302–308, 353

(56) References Cited

U.S. PATENT DOCUMENTS 3,912,235 A 10/1975 Janssen
4,248,379 A 2/1981 Hollstein et al.
4,627,465 A 12/1986 Kolibas et al.

FOREIGN PATENT DOCUMENTS

GB 1 485 255 9/1977

OTHER PUBLICATIONS

Patent Abstracts of Japan. Publication #55022355, Feb. 18, 1980, Kansai Paint Co Ltd, "Color–Changing Coating Method and Apparatus".

*Primary Examiner*—David A. Scherbel
*Assistant Examiner*—Thach H. Bui
(74) *Attorney, Agent, or Firm*—Browdy and Neimark, P.L.L.C.

(57) ABSTRACT

The invention concerns a device (10) for supplying a powdery coating product to a sprayer (1) in an installation spraying such a product. The invention is characterized in that it comprises at least two modules (11, 14) connected each to a source ($B_1$–$B_4$) of coating product and forming each part (112, 113) of a common manifold (C) connected to said sprayer (1) for circulating said product (P1–P4).

15 Claims, 6 Drawing Sheets

DEVICE FOR SUPPLYING A POWDERY COATING PRODUCT TO A SPRAYER AND SPRAY INSTALLATION COMPRISING SAME

The invention relates to a device for supplying powdery coating product to a sprayer and to an installation for spraying powdery coating product comprising, inter alia, such a device.

In the domain of installations for spraying powdery coating product, it is known to supply each sprayer of an installation with a mixture of coating product and a conveyance gas which is most often air. In certain installations, a sprayer must be supplied with a plurality of types of coating product which are used selectively, as a function of the nature of the coating to be produced. For example, in the case of an installation for spraying coating product on automobile vehicle bodies, it is necessary to provide painting each body in the colour chosen by the customer.

By FR-A-2 441 435, it is known to cause lines connected to different reservoirs of powdery product to converge towards a dispenser in which they are arranged as a cone. The spatial distribution and the number of these lines are imposed by the geometry of the dispenser. It is thus necessary to provide different types of dispenser as a function of the number of coating products having to supply the sprayer. In addition, complex systems for cleaning the different pipes and dispensers must be provided.

This device presents such dimensions that it must necessarily be placed at a distance from the sprayer that it supplies, with the result that the pipe connecting the dispenser to the sprayer must be cleaned, whenever the product is changed, over a relatively long distance, this increasing the quantities of product wasted and the time for changing the product.

JP-A-55-022 355 furthermore discloses a one-piece manifold into which open out coating product supply conduits. This common manifold cannot develop as a function of the number of conduits to be connected. The same applies to the mixture known from U.S. Pat. No. 3,912,235 which comes under the technical domain of thermal projection.

It is more particularly these drawbacks that the invention intends to overcome by proposing a supply device which makes it possible to supply a sprayer with at least two types of powdery coating product, this device being easily adaptable to the number of products to be used and being able to be easily exchanged.

In this spirit, the invention concerns a device for supplying a sprayer with a powdery coating product, this device comprising at least two modules each connected to a source of coating product and each forming a part of the principal channel of a common manifold connected to the sprayer for circulating the product.

Thanks to the invention, the modular structure of the device of the invention makes it possible to adapt the number of modules used to the number of different sources of coating product, the common manifold being created, as additional modules are added, by the modules themselves. The modular structure of the device of the invention makes it possible to give it relatively small dimensions allowing it to be implanted as close as possible to a sprayer, particularly at the level of an arm of a robot displacing the sprayer opposite the objects to be coated. The length of pipe having to be cleaned downstream of this device, whenever coating product is changed, is short, which is advantageous in terms of quantity of product wasted and the time for changing product.

According to advantageous but non-obligatory aspects of the invention, the device incorporates one or more of the following characteristics:

- it comprises a cleaning module connected to a source of cleaning fluid and forming an upstream part of the common manifold.
- each module comprises at least one valve adapted to place an inlet of the module, connected to the source of product or of cleaning fluid, and the manifold, selectively in communication. Such a valve makes it possible to control each module so that it delivers, or not, coating product or cleaning fluid to the common manifold and that it thus supplies, or not, the sprayer.
- each module comprises a conduit connecting an inlet of the module to the part of the manifold formed by this module while the manifold formed by the different modules extends in a first direction and the conduit of each module extends in a second direction, the angle between these directions, taken in the direction of flow of the product in this conduit and this manifold, being an acute angle. This geometry of the modules allows an easy transition of the flow of the mixture of entraining gas and of coating product between the conduit and the part of the manifold formed in each module.
- the modules are assembled in reversible manner, their number being able to be adapted to the number of sources of coating product to which the sprayer must be connected.
- each module comprises a base element in which is formed the part of the manifold and a zone of join of the manifold with a conduit. Each module also comprises a connection element defining the inlet of the conduit and a valve for controlling the flow of the product in the conduit, this valve being disposed between the base element and the connection element. Each module is thus formed by two essential elements and by a valve captive between these elements and protected thereby from the outside.

According to an advantageous form of embodiment of the invention, at least one of the modules forms a first supply conduit of the manifold and a second supply conduit of a channel for recirculation of the coating product, these first and second conduits extending from a common inlet of the module. In this embodiment, a circulation of the mixture of entraining gas and of powdery coating product may be permanently maintained up to each module, the mixture of air and of powder being directed either towards the supply manifold of the sprayer or towards the channel for recirculation. This avoids the transient states of placing the powder in movement as well as the cleaning of the supply conduits of each module. This embodiment is therefore particularly advantageous concerning the time for changing coating product and the minimization of the quantities of product wasted during a change. In that case, it may be provided that the first and second conduits each be equipped with a controlled valve adapted to allow and/or interrupt flow of the coating product in the conduit in question.

The valves used are advantageously sleeve type valves which present the particular advantage of operating without impediment in a relatively aggressive environment, i.e. in contact with a mixture of air and of powder.

The invention also relates to an installation for spraying powdery coating product which comprises at least one sprayer supplied by a device such as described hereinabove. Such an installation is economical to manufacture, due to the modular nature of the device, and to exploit, due to the minimization of the quantities of coating product wasted and of the rapid time for changing shade. Such an installation is easily adapted to the variations of its conditions of use, particularly to the number of coating products capable of supplying each sprayer.

The invention will be more readily understood and other advantages thereof will appear more clearly in the light of the following description of two coating product supply devices integrated in a spraying installation in accordance with its principle, given solely by way of example and made with reference to the accompanying drawings, in which.

Figure 1:
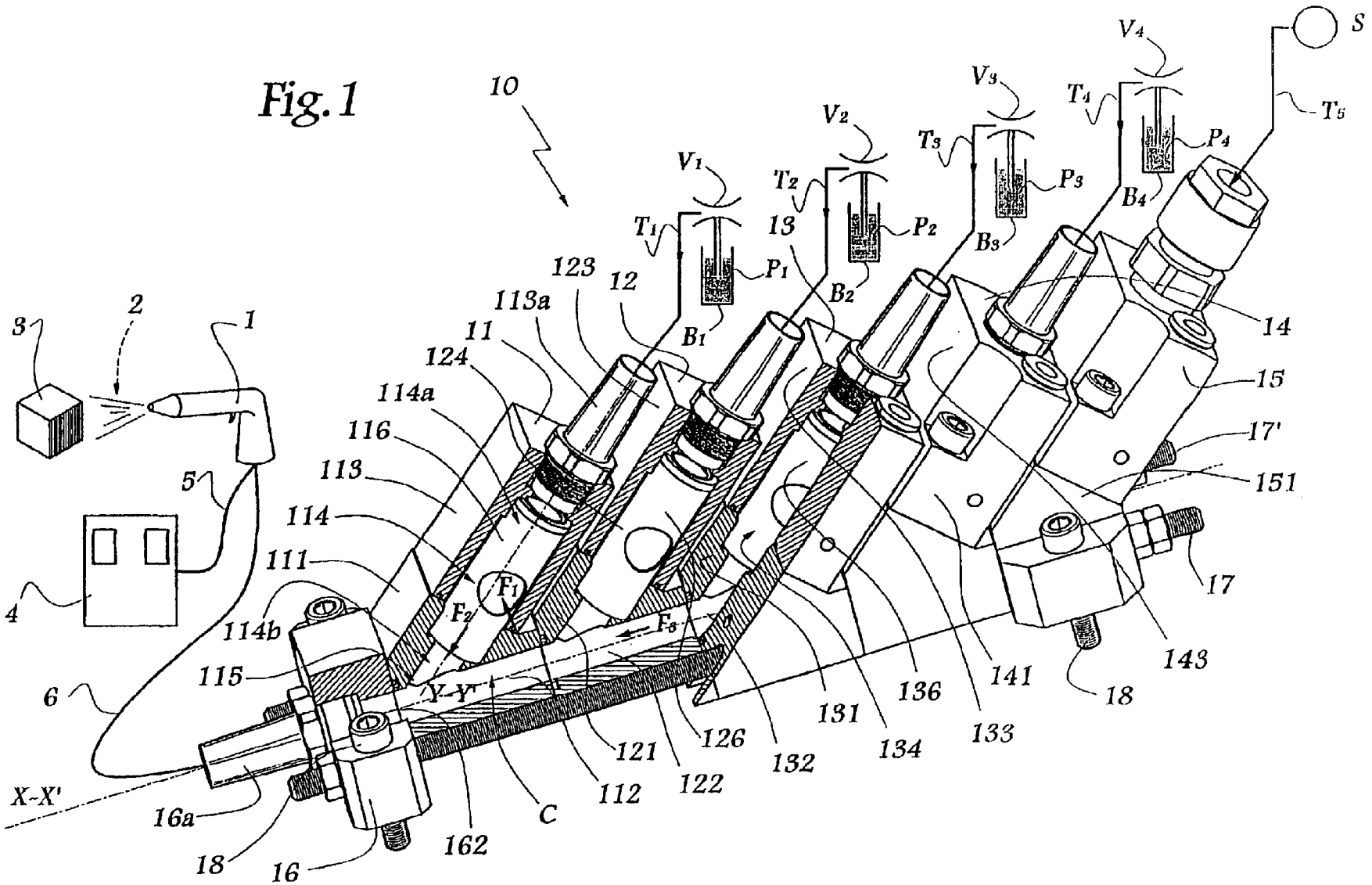
FIG. 1 is a schematic view, with parts torn away, of an installation for spraying coating product in accordance with a first form of embodiment of the invention.
Figure 2:
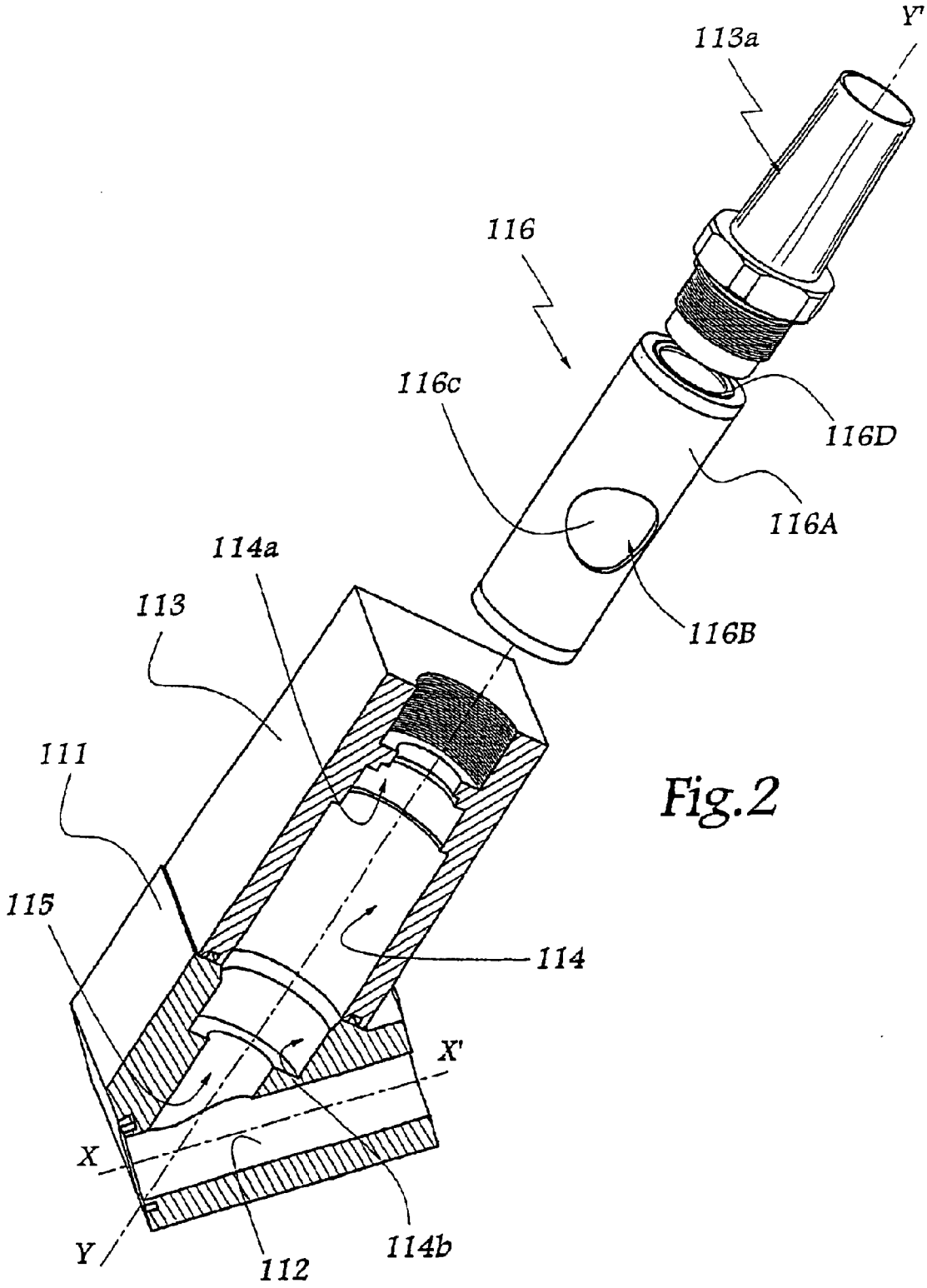
FIG. 2 is an exploded view in perspective, with a constituent module of the supply device used in the installation of FIG. 1, torn away.

The installation shown in FIG. 1 comprises a sprayer 1 of manual type intended to spray a cloud 2 of a mixture of entraining gas and of powdery coating product onto objects 3 to be coated. The sprayer 1 is of electrostatic type and is connected to a high-voltage unit 4 thanks to a conducting cable 5.

The sprayer 1 is also supplied with a mixture of entraining gas and of powdery coating product thanks to a flexible pipe 6 connected to a device 10 for supplying it selectively with a product from among four products P1, P2, P3 and P4 respectively contained in four vats B1, B2, B3 and B4 and pumped thanks to Venturi effect suction systems V1, V2, V3, V4. The device 10 is connected to each Venturi V1 to V4 by a pipe T1 to T4.

The device 10 comprises four modules 11, 12, 13, 14, modules 11 and 12 being shown in FIG. 1 with a half torn away, while module 13 is shown with a quarter torn away and module 14 is shown without any parts torn away. The device 10 comprises a fifth module 15 connected to a source of pressurized air S by a pipe T5. The device 10 also comprises a head 16 from which extends a connection element 16*a* intended to cooperate with the pipe 6.

X–X' denotes the axis of symmetry of the element 16*a*. The modules 11 to 15 and the head 16 are juxtaposed along axis X–X'.

The module 11 comprises a base element 111 in which is formed a channel 112 which extends, when the device 10 is in mounted configuration, in the direction of axis X–X', passing right through the element 111.

The module 11 also comprises a second element 113 bearing a element 113*a* for connection with pipe T1. The interior volume of the element 113 defines, with element 111, a conduit 114 of substantially cylindrical shape and of which Y–Y' denotes the central axis. The conduit 114 extends in element 111 up to a zone of join 115 with the channel 112. In other words, the conduit 114 opens out into the channel 112 at the level of zone 115.

114A denotes the upstream part of the conduit 114 formed the element 113 and 114B its downstream part formed in the element 111 and terminate in zone 115. A sleeve valve 116 is arranged in the conduit 114, in both parts 114A and 114B. In fact, the valve 116 is arranged between elements 111 and 113.

Figure 3:
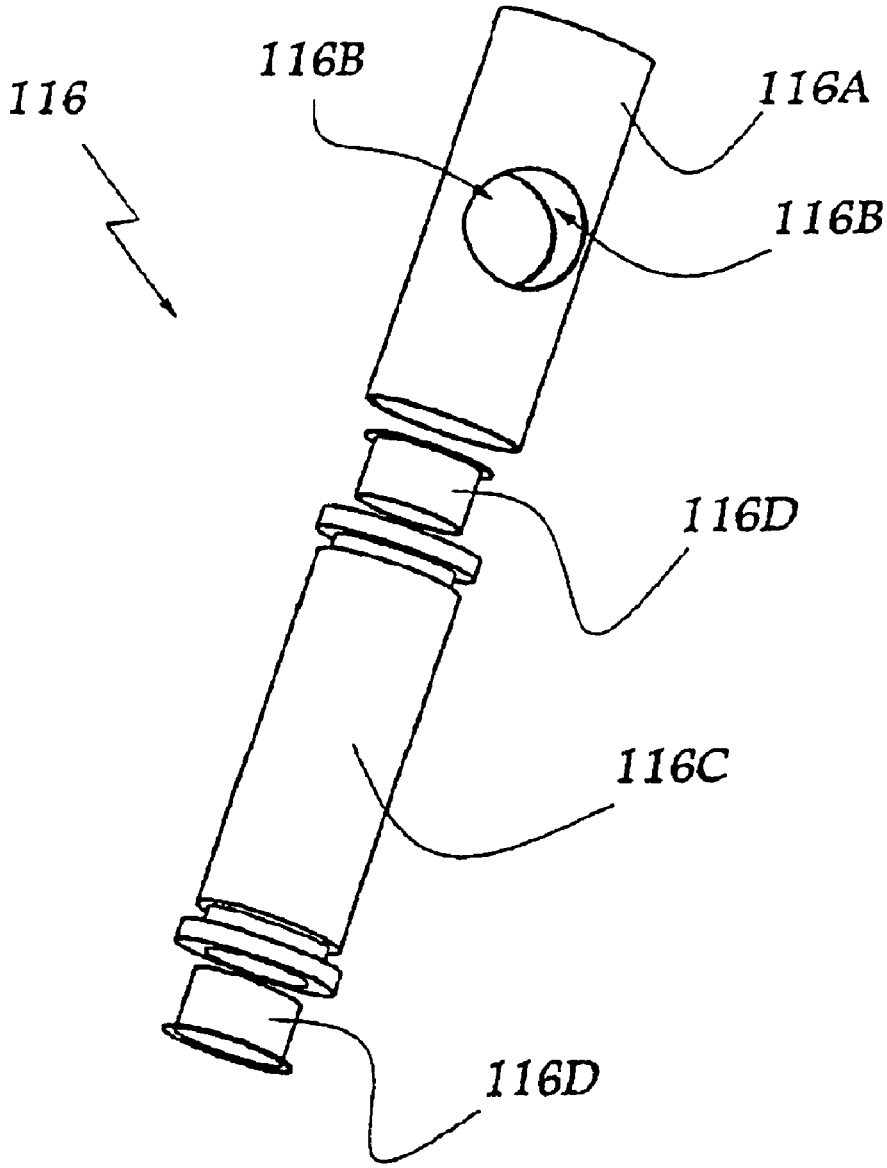
FIG. 3 is an exploded view in perspective of a sleeve valve used in the module of FIG. 2.
Figure 4:
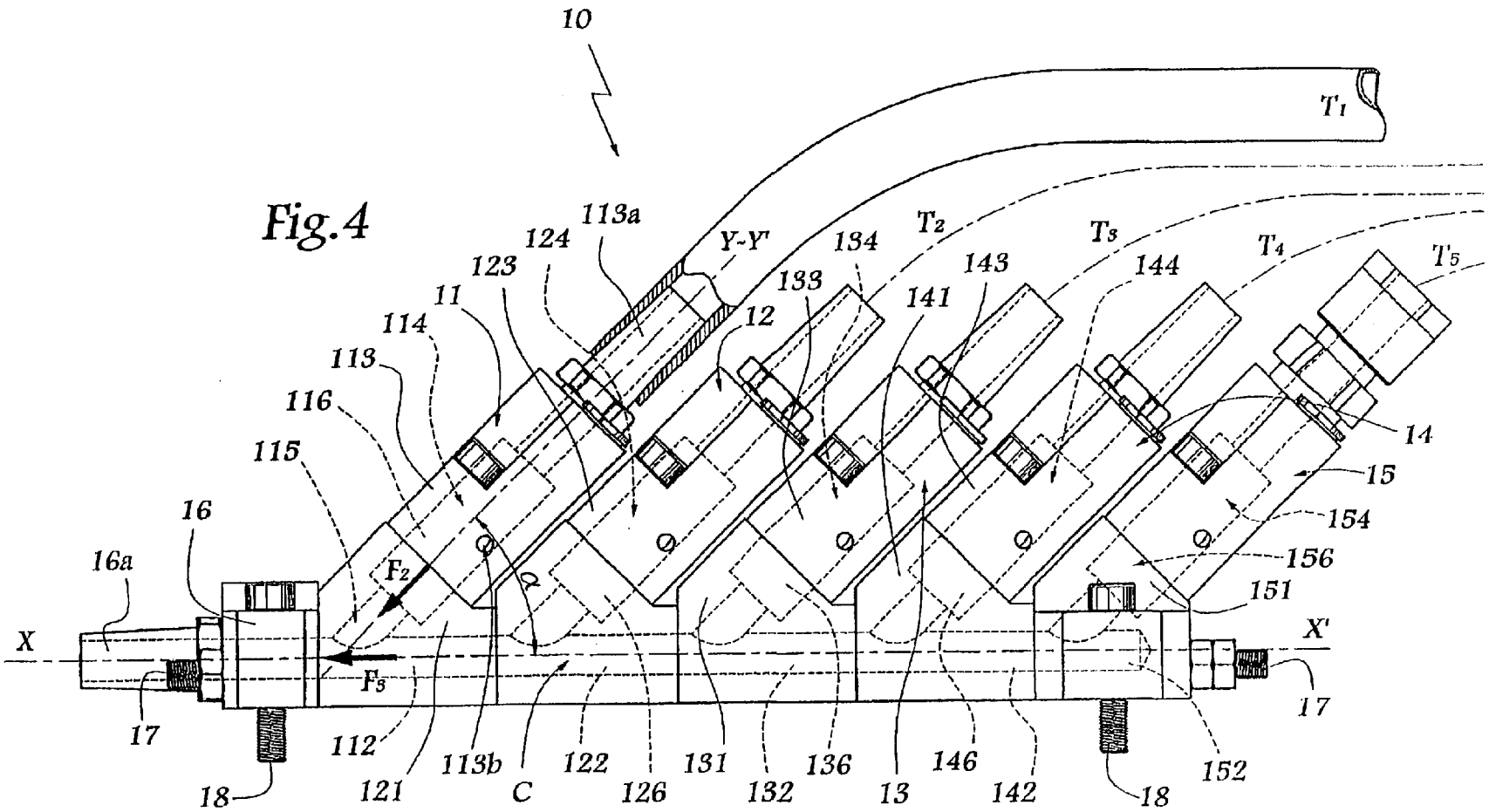
FIG. 4 is a side view of the supply device used in the installation of FIG. 1.

The structure of the valve 116 is more particularly visible in FIG. 3. This valve comprises a tubular element 116A pierced with two radial orifices 116B and inside which is arranged an elastic sleeve 116C maintained in place in the element 116A thanks to two rings 116D. When a circulation of air is to occur in conduit 114, the sleeve 116C remains applied against the inner surface of the element 116. When the circulation in the conduit 114 is to be interrupted, a control air pressure is applied on the sleeve 116C through the orifices 116B, as represented by arrow F1 in FIG. 1, which has the effect of pinching the sleeve 116C and of thus cutting the flow in the conduit 114. An orifice 113*b* visible in FIG. 4 is provided in the element 113 for the admission of control air up to the valve 116.

The modules 12, 13 and 14 are identical to the module 11 and each formed by a base element 121, 131 or 141 and by a connection element 123, 133 or 143. Each module 12, 13 and 14 also comprises a sleeve valve 126, 136 or 146.

The element 121 defines a channel 122 which is substantially aligned with the channel 112, along axis X–X', when the device 10 is in mounted configuration. In the same way, the modules 13 and 14 each define a channel 132, 142 likewise aligned on axis X–X' and with an axial passage 162 of the head 16. The elements 112, 122, 132, 142 and 162 thus form a manifold C through which may circulate an air/powder mixture coming from one of the pipes T1 to T4 through the conduit 114 or one of the equivalent conduits 124, 134 or 144 of the modules 12, 13 and 14.

The module 15 also defines a conduit 154 which opens out in a channel 152 aligned with the channel 142 of the module 14 when the device is in mounted configuration. The module 15 is also equipped with a sleeve valve 156 making it possible to open or to close the conduit 154.

When the valve 156 of the module 15 is open, while valves 116, 126, 136 and 146 are closed, air flows from the source S in the direction of the sprayer 1, successively traversing the channels 152, 142, 132, 122, 112 and the passage 162, as well as the element 16A and the pipe 6. This makes it possible to clean the device 10, the pipe 6 and the sprayer 1 in particularly simple and rapid manner.

The elements 11 to 16 are maintained in the form of a mechanical unit thanks to two threaded rods 17 and 17' which pass through the base elements 111 and equivalent and the base element 151 of the module 15 as well as the head 16.

The head 16 and the module 15 are likewise each provided with two screws 18 allowing the element 10 to be mounted on a plate (not shown).

The modular nature of the device 10 makes it possible to adapt the number of modules 11 or equivalent to the number of coating products having to be supplied to the sprayer 1. For example, if an additional coating is to be used in the installation of FIGS. 1 to 4, it suffices to insert between the module 11 and the head 16 a module identical to module 11 and to change the rods 17 and 17' to use rods of suitable length. The fact that each module 11 or equivalent constitutes a part of the common manifold C therefore makes it possible to permanently adapt the length of this manifold to the effective number of modules used.

Arrow F2 represents the flow of a mixture of entraining gas and of coating product in the conduit 114. Arrow F3 represents the flow of coating product in the channel 112. Arrow F2 is disposed in direction Y–Y' and oriented towards the channel 112 while arrow F3 is disposed in the direction of axis X–X' and towards the head 116. The angle $\alpha$ between the directions of arrows F2 and F3 is of the order of 45°, with the result that the change of direction of the flow in the zone 115 is not too sudden, this avoiding an accumulation of powder in this zone and a possible "rise" of the mixture towards the modules 12 and following.

In practice, two possibilities may be considered, the angle α varying from 20° to 90°.

for powders which are relatively easy to transport in an air flow, the smaller the angle α is, the more the pressure drops at the level of zone 115 are slight. The angle α is chosen between 20 and 45°, the value of 20° being a minimum for a reason of mechanical design, while the value of 45° corresponds to a maximum inclination for a smooth flow. The flowrate of powder used may in that case be great.

for powders which are relatively difficult to transport, the agglomerates formed by fusion of the powder in the zone 115 should be avoided. To that end, the speed of the air/powder mixture and the disturbances generated by a pronounced angle α, for example included between 45° and 90°, is privileged. Such an angle prevents the powder from being deposited in zone 115. In an unfavourable case where a slight deposit is formed, it would be evacuated by the air/powder mixture arriving thereafter. The choice of the values of the angle α is then made to the detriment of the maximum flowrate and may generate rises of powder towards the upstream of the manifold C.

Figure 5:
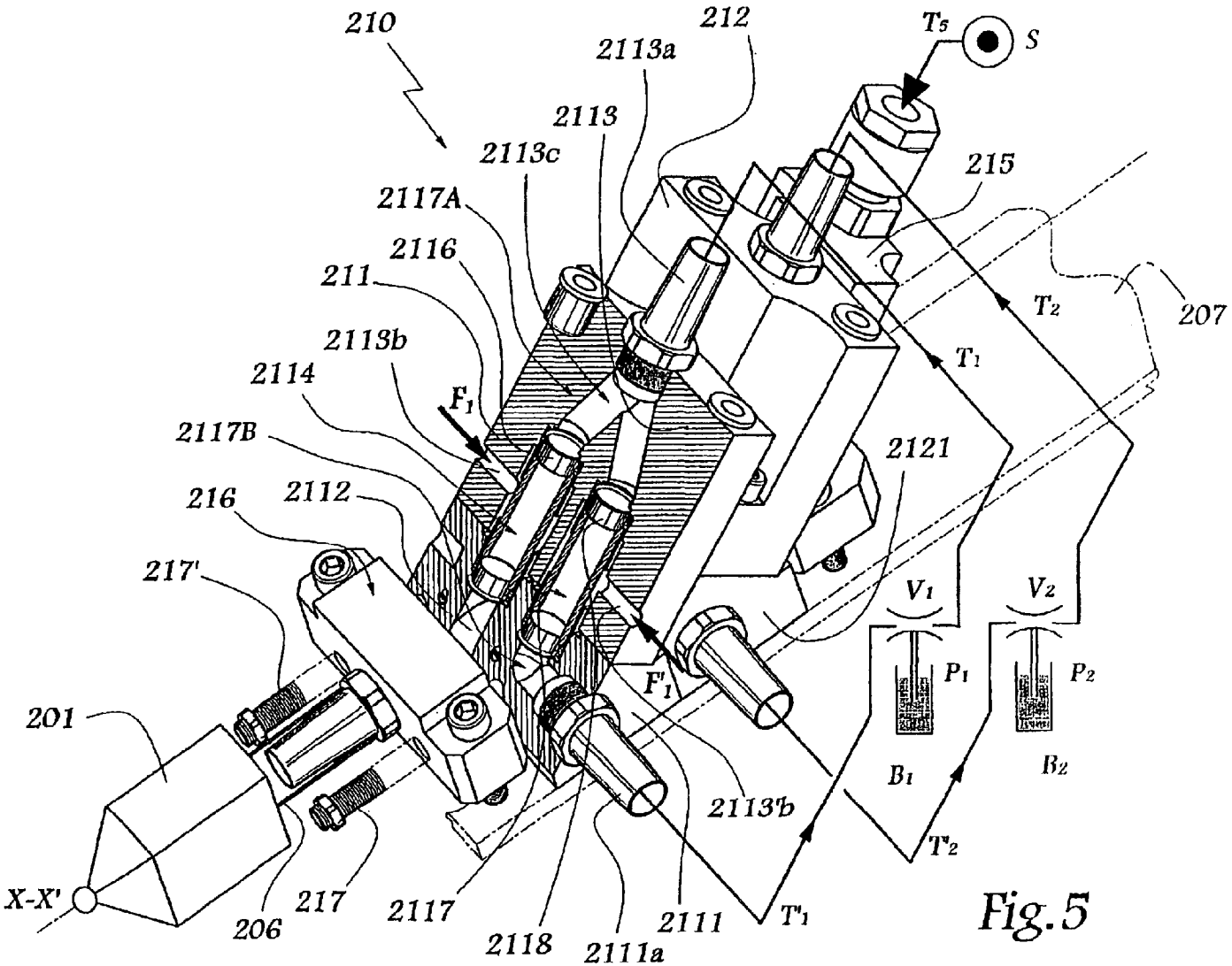
FIG. 5 is a view similar to FIG. 1 for an installation in accordance with a second form of embodiment of the invention.
Figure 6:
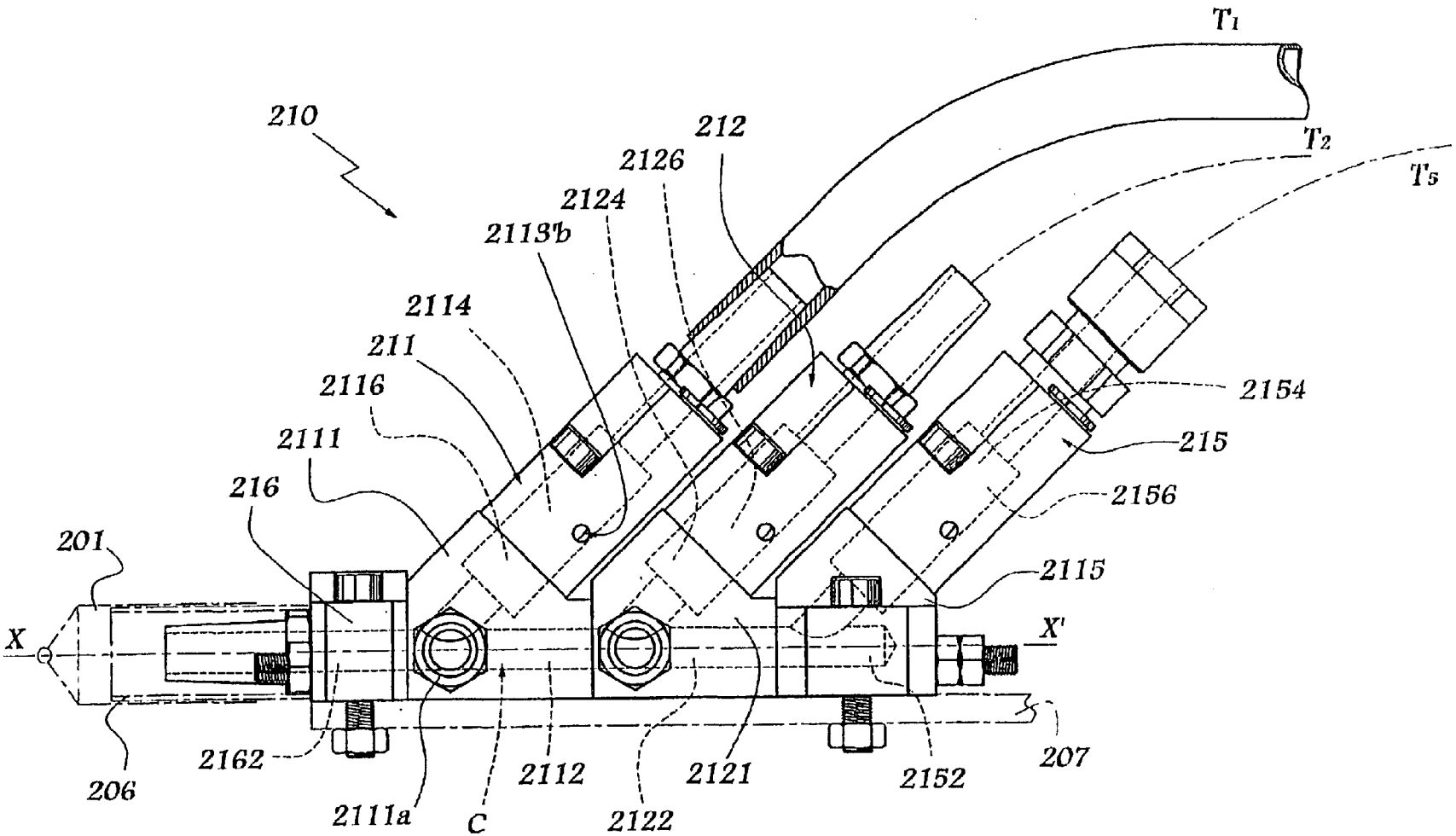
FIG. 6 is a side view of the supply device used in the installation of FIG. 5.

In the second form of embodiment of the invention shown in FIGS. 5 and 6, the elements similar to those of the first embodiment bear identical references increased by 200.

The sprayer 201 of this form of embodiment is an automatic sprayer supported by the arm 207 of a robot. A device 210 is provided for supply of the sprayer 201 from two vats B1, B2 each containing a coating product P1, P2 respectively, and equipped with a Venturi entrainment system V1, V2 respectively.

The device 210 comprises a first module 211 represented with a half torn away and a module 212 shown in an outside view, as well as a cleaning module 215 connected to a pressurized air source S.

The modules 211 and 212 are respectively connected by a pipe T1, T2 to the Venturi devices V1 and V2, while module 215 is connected to a source S of pressurized air by a pipe T5.

The module 211 comprises a base element 2111 in which is formed a channel 2112 extending essentially in the direction of an axis X–X'. The base element 2121 of the module 212 also defines a channel 2122 which is aligned with the channel 2112 when the device is in mounted configuration. As for the cleaning module 2115, it defines an end part 2152 of channel in its base element 2151. A head 216 constitutes the downstream part of the device 210 and is provided with a passage 2162 which is aligned with the channnels 2112, 2122 and 2152, thus forming a manifold C for the coating product coming from a conduit 2114 of the module 211, or from a conduit 2124 of the module 212.

The cleaning module 215 is also provided with a conduit 2154 for injecting cleaning air coming from the source S in the upstream part 2152 of the manifold C.

Each conduit 2114 or 2124 is equipped with a sleeve valve 2116 or 2126.

As previously, the valve 2116 is controlled by injection of air, as represented by arrow F1 in FIG. 5.

Parallel to conduit 2114, a conduit 2117 extends, from the inlet 2113*a* of a connection element 2113 of the module 211 up to in the base element 2111. This channel comprises an upstream part 2117A formed in the element 2113 and a downstream part 2117B formed in the element 2111, a sleeve valve 2118 being housed in this conduit, between elements 2111 and 2113.

The downstream part of the conduit 2117 is bent by about 90°, with the result that it makes it possible to supply a connection element 2111*a* connected to the vat B1 by a pipe T'1 for recirculation. The conduit 2117 might also be bent by an obtuse angle, the choice of the value of this angle being able to be made as a function of the nature of the powder, as indicated hereinabove with reference to angle α.

2113*b* denotes the conduit in which the control air is injected around the supple part of the sleeve valve 2116, as represented by arrow F1. 2113'*b* denotes the channel, likewise formed in the element 2113, through which the control air is injected around the sleeve valve 2118, as represented by arrow F'1.

Operation is as follows: From a branching 2113*c* between the conduits 2114 and 2117, the mixture of air and of entraining gas coming from the vat B1 through the pipe T1 is directed either towards the channel C, through the conduit 2114 and the valve 2116, or towards the recirculation pipe T'1 through the channel 2117, the valve 2118 and the connection element 2111*a*.

The sleeve valves 2116 and 2118 are piloted, as represented by arrows F1 and F'1, to be opened and closed in phase opposition, one of these valves being open when the other is closed. Coating product may circulate permanently in the pipe T1, being directed either towards the manifold C, or towards the pipe T'1. In this way, when it is necessary to use a new product P1 or P2, no transitory phase of moving the mixture of entraining gas/product has to be provided, the time for changing coating product between the products P1 and P2 thus being very rapid.

The second module 212 is made in the same manner and makes it possible to cause the coating product P2 to be recirculated in the direction of the vat B2 thanks to a pipe T'2.

Likewise as previously, the modules 211 and 212 are assembled in reversible manner thanks to threaded rods 217 and 217'. It is thus possible to adapt the number of modules of the device 210 to the number of coating products to be used.

The module 210 is particularly compact and, in this respect, it may be mounted on the arm 207 of the robot supporting the sprayer 201. In this way, the length of the pipe 206 connecting the device 210 to the sprayer 201 may be minimized, which makes it possible likewise to minimize the quantities of coating product wasted during a change of product, these quantities corresponding approximately to the quantity of coating product located in the manifold C and in the conduit 206. The small volume of the pipe 206 also facilitates rapid cleaning thereof.

A mixed installation with one or more modules of the type of module 11 and one or more modules of the type of module 211 may be envisaged, in the same way as an association of modules whose conduits have different angles of inclination α with respect to the principal direction of the manifold C.

What is claimed is:

1. A device for supplying a powdery coating product to a sprayer in an installation for spraying the powdery coating product, said device comprising at least two modules each connectable to a respective source of coating product, wherein each of said modules comprises a base element in which is formed a channel extending in a first direction, and said modules are detachably connected together to place said channels in line with one another so that said base elements form a common manifold having a principal channel defined by said channels, said common manifold being connectable to the sprayer for circulating the powdery coating product.

2. The device according to claim 1, wherein one of said modules is a cleaning module connected to a source of cleaning fluid and forming an upstream part of said common manifold.

3. The device according to claim 1, wherein each of said modules comprises at least one valve for placing an inlet of said module selectively in communication with said common manifold.

4. The device according to claim 3, wherein said at least one valve of each of said modules is a sleeve type valve.

5. The device according to claim 1, wherein:

each each of said modules comprises a conduit connecting an inlet of said module to said base element of said module;

said common manifold formed by said base elements extends in a first direction along said principal channel and said conduit of each of said modules extends in a second direction that forms an acute angle with the first direction.

6. The device according to claim 1, wherein the number of said modules is selected on the basis of the number of sources of coating product to be connected the sprayer.

7. The device according to claim 1, wherein each of said modules further comprises:

a conduit connected to the respective source of coating product and connected to said base element at a joining zone;

a connection element defining the inlet of said conduit; and a valve for controlling the flow of coating product in said conduit, said valve being disposed between said base element and said connection element.

8. The device according to claim 7, wherein said valve of each of said modules is a sleeve type valve.

9. The device according to claim 1, wherein at least one of said modules forms a first conduit for supplying said common manifold and a second conduit for supplying a channel for recirculation of the coating product towards a source of the coating product said first and second conduits extending from a common inlet of said module.

10. The device according to claim 7, wherein said first and second conduits are each equipped with a controlled valve adapted to allow and/or interrupt the flow of coating product in the conduit in question.

11. The device according to claim 10, wherein at least one of said controlled valves is a sleeve type valve.

12. The device according to claim 1, in combination with at least one sprayer.

13. The device according to claim 1, further comprising connecting elements connecting said modules together.

14. An installation for spraying powdery coating product comprising: the device according to claim 1; and at least one sprayer coupled to said common manifold.

15. The installation of claim 14, further comprising at least two sources of coating product each connected to a respective one of said modules.

* * * * *

UNITED STATES PATENT AND TRADEMARK OFFICE

CERTIFICATE OF CORRECTION

PATENT NO. : 6,908,048 B2
APPLICATION NO. : 10/343632
DATED : June 21, 2005
INVENTOR(S) : Michel Di Gioia et al.

It is certified that error appears in the above-identified patent and that said Letters Patent is hereby corrected as shown below:

Title Page
section (22), the PCT filing date should read --August 1, 2001-- .

Signed and Sealed this

Twenty-third Day of January, 2007

JON W. DUDAS
*Director of the United States Patent and Trademark Office*